US008963410B2

(12) United States Patent
Wu

(10) Patent No.: US 8,963,410 B2
(45) Date of Patent: Feb. 24, 2015

(54) LED BULB

(71) Applicant: Well Shin Technology Co., Ltd., Taipei (TW)

(72) Inventor: Jui Hsiung Wu, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 116 days.

(21) Appl. No.: 13/858,664

(22) Filed: Apr. 8, 2013

(65) Prior Publication Data

US 2014/0300269 A1 Oct. 9, 2014

(51) Int. Cl.

| | |
|---|---|
| ***F21V 29/00*** | (2006.01) |
| ***F21V 21/00*** | (2006.01) |
| ***F21V 17/00*** | (2006.01) |
| ***F21K 99/00*** | (2010.01) |

(52) U.S. Cl.

CPC . *F21K 9/13* (2013.01); *F21K 9/135* (2013.01); *F21K 9/1355* (2013.01)

USPC ..... 313/318.01; 313/42; 362/294; 362/545; 362/249.02

(58) Field of Classification Search

CPC ..... F21V 23/00; F21V 23/003–23/009; F21V 19/0025; F21V 19/003–19/0045; F21K 9/135–9/1355

USPC ..... 313/317, 318.01, 318.12, 42–46; 362/294, 545, 249.02, 555, 800

See application file for complete search history.

(56) References Cited

U.S. PATENT DOCUMENTS

| | | | | |
|---|---|---|---|---|
| 8,760,042 | B2 * | 6/2014 | Sakai et al. | 313/46 |
| 2007/0247840 | A1 * | 10/2007 | Ham | 362/227 |
| 2010/0096992 | A1 * | 4/2010 | Yamamoto et al. | 315/112 |
| 2010/0290236 | A1 * | 11/2010 | Gingrich et al. | 362/373 |
| 2011/0028015 | A1 * | 2/2011 | Mostoller et al. | 439/280 |
| 2012/0147608 | A1 * | 6/2012 | Kawagoe et al. | 362/294 |
| 2012/0217870 | A1 * | 8/2012 | Soni | 315/32 |
| 2012/0314422 | A1 * | 12/2012 | Dong et al. | 362/311.02 |

* cited by examiner

*Primary Examiner* — Mariceli Santiago
(74) *Attorney, Agent, or Firm* — WPAT, P.C.; Anthony King

(57) ABSTRACT

A LED bulb includes a bulb head, a power PCBA of which a bottom is equipped with power pins, a LED PCB mounted to a top of the power PCBA and electrically connecting with the power PCBA, and a cover covered on the LED PCB. The bulb head includes a housing, electrical terminals disposed in the housing and including an anode terminal and a cathode terminal, and a power connection unit mounted to a bottom of the housing and including a bulb base and an anode element. One end of the anode terminal is electrically connected with a top end of the anode element. One end of the cathode terminal projects outside the housing to be electrically connected with the bulb base. The power PCBA is mounted on the housing. The power pins are electrically connected with another two ends of the anode terminal and the cathode terminal.

16 Claims, 8 Drawing Sheets

LED BULB

BACKGROUND OF THE INVENTION

1. Field of the Invention

The present invention relates to a light fixture, and more particularly to a LED bulb.

2. The Related Art

In recent years, the LED (light-emitting diode) utilizes some features of small volume, low driving voltage, shock resistance, long life and environmental friendly, to replace the traditional light source and be widely used in light fixtures, such as LED bulb. With the unceasing development and progress of science and technology, the LED bulb has higher luminous efficiency than tungsten lamps and fluorescent tubes. Moreover, the electronic components become more and more light, thin, short and small, so that make the LED bulb gradually replace the tungsten lamp to be largely and widely used in our daily life.

The traditional LED bulb includes a bulb head, a power PCBA (printed circuit board assembly), a illumination module and a cover. The electrical connection between the bulb head and the power PCBA and between the power PCBA and the illumination module is realized by welding a wire or fixing a wire with screw pins therebetween. However, due to the space inside the LED bulb is small, a high temperature is apt to happen in use. As a result, it easily causes some consequences such as wire breakage, loose wire solder joints or the wire getting loose from the screw pins etc. That is apt to result in a short circuit, an open circuit or unstable illumination, even possibly burn the LED bulb or get an electric shock etc.

SUMMARY OF THE INVENTION

An object of the present invention is to provide a LED bulb which includes a bulb head, a power PCBA, a LED PCB and a cover. The bulb head includes a housing, a plurality of electrical terminals and a power connection unit. The electrical terminals are apart disposed in the housing and include an anode terminal and a cathode terminal. The power connection unit is mounted to a bottom of the housing and includes a bulb base and an anode element. The anode element is mounted to a bottom of the bulb base and projects upward in the bulb base. One end of the anode terminal is electrically connected with a top end of the anode element. One end of the cathode terminal projects outside the housing to be electrically connected with the bulb base. A bottom of the power PCBA is equipped with two power pins. The power PCBA is mounted on the housing. The power pins are electrically connected with another two ends of the anode terminal and the cathode terminal respectively. The LED PCB is mounted to a top of the power PCBA and electrically connects with the power PCBA. The cover is covered on the LED PCB.

As described above, the electrical connection between the LED head and the power PCBA is realized by the power connection unit and the electrical terminals, and the electrical terminals and the power pins instead of wires. It effectively saves the space inside the LED bulb. Moreover, the above-mentioned connection way can achieve steady electrical connection even if a high temperature happens in use. So the LED bulb of the present invention has a safe use and a steady illumination.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
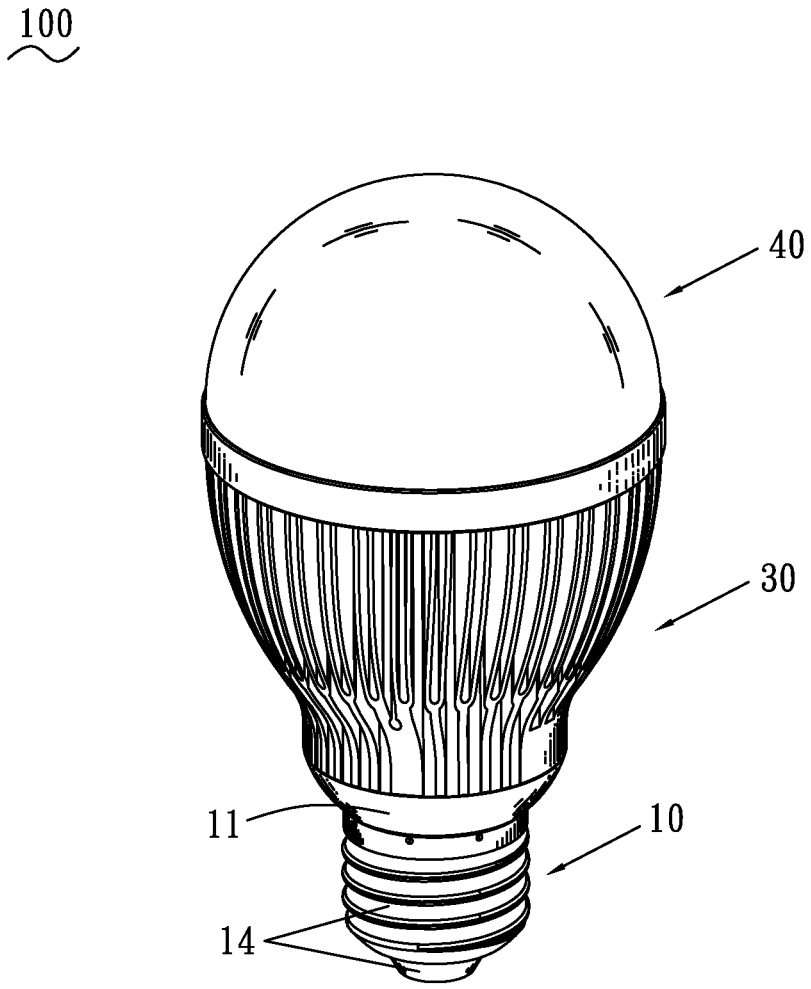
FIG. 1 is an assembled perspective view of a LED bulb according to an embodiment of the present invention.
Figure 2:
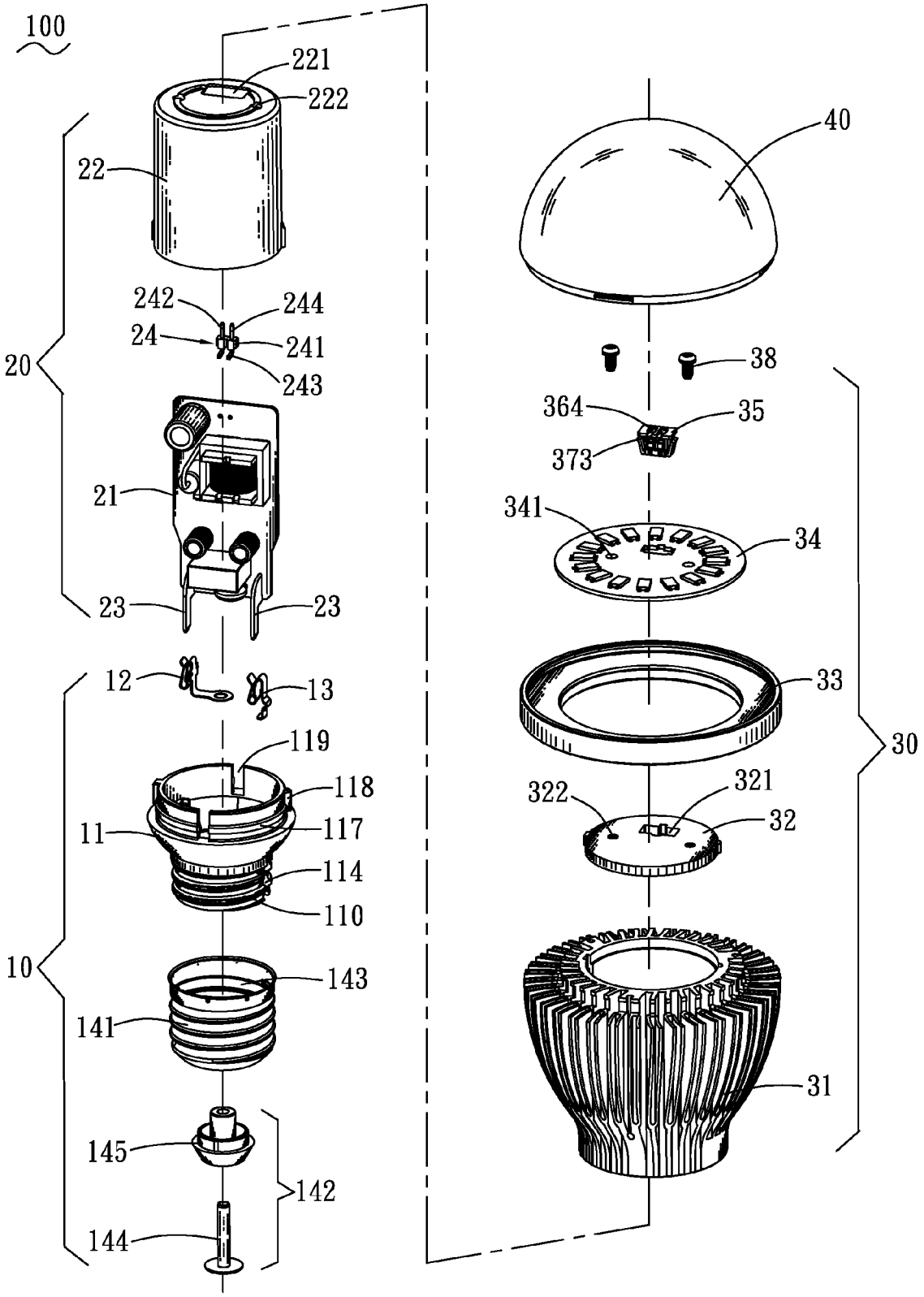
FIG. 2 is an exploded perspective view of the LED bulb of FIG. 1.

Referring to FIG. 1 and FIG. 2, a LED bulb 100 according to an embodiment of the present invention includes a bulb head 10, a power module 20 mounted on the bulb head 10, an illumination module 30 mounted on the bulb head 10 with the power module 20 being received therein, and a cover 40 covered on the illumination module 30.

Figure 3:
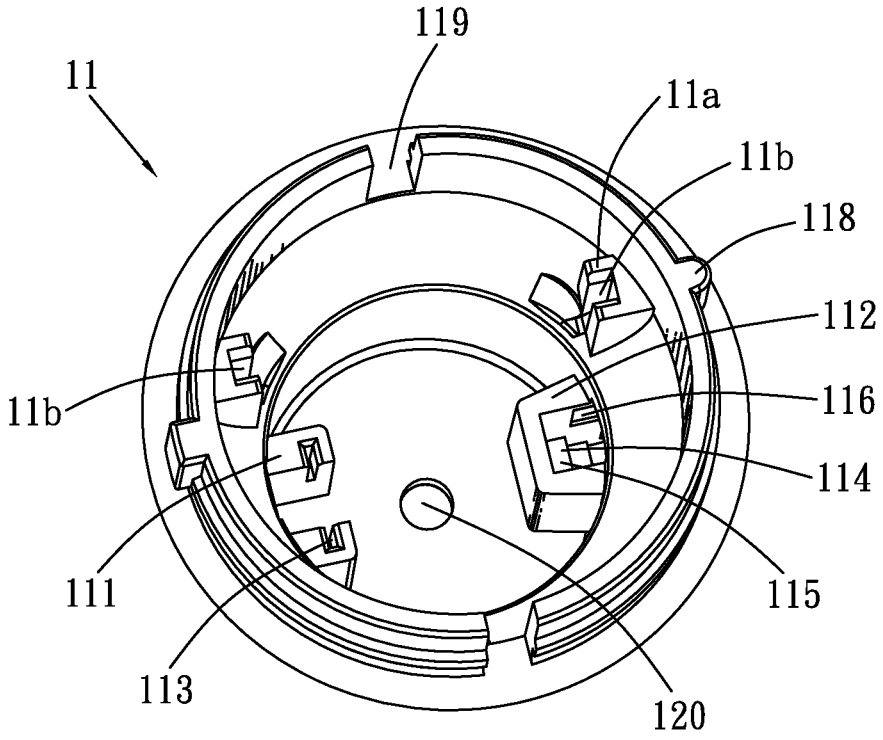
FIG. 3 is a perspective view of a housing of the LED bulb of FIG. 2.

Referring to FIG. 1, FIG. 2 and FIG. 3, the bulb head 10 includes a housing 11, a plurality of electrical terminals and a power connection unit 14. The housing 11 is of hollow cone shape and a top thereof is freely opened. Two opposite parts of the insidewall of the housing 11 protrude inward to form a pair of positioning blocks 11 a at an upper position, and two spaced fastening blocks 111 and a U-shaped receiving frame 112 at a lower position. A pair of positioning slots 11*b* is opened in two face-to-face sides of the positioning blocks 11*a* and further penetrates upward through the positioning blocks 11*a* respectively. A pair of fastening slots 113 is opened in two face-to-face sides of the fastening blocks 111 and further penetrates upward through the fastening blocks 111. The receiving frame 112 defines a receiving chamber 114 further penetrating outward through the housing 11. A bottom of an inner side of the receiving frame 112 protrudes into the receiving chamber 114 to form a supporting board 115. Two opposite inner sides of the receiving chamber 114 are oppositely concaved to form a pair of fixing fillisters 116. A bottom wall of the housing 11 defines a through hole 120. The housing 11 defines a male thread 110 around the outside of a bottom part thereof. A ring-shaped locking rib 117 is protruded outward around the outside of a top end of the housing 11. The top end of the housing 11 further defines at least one gap 119 and at least one positioning portion 118.

Figure 4:
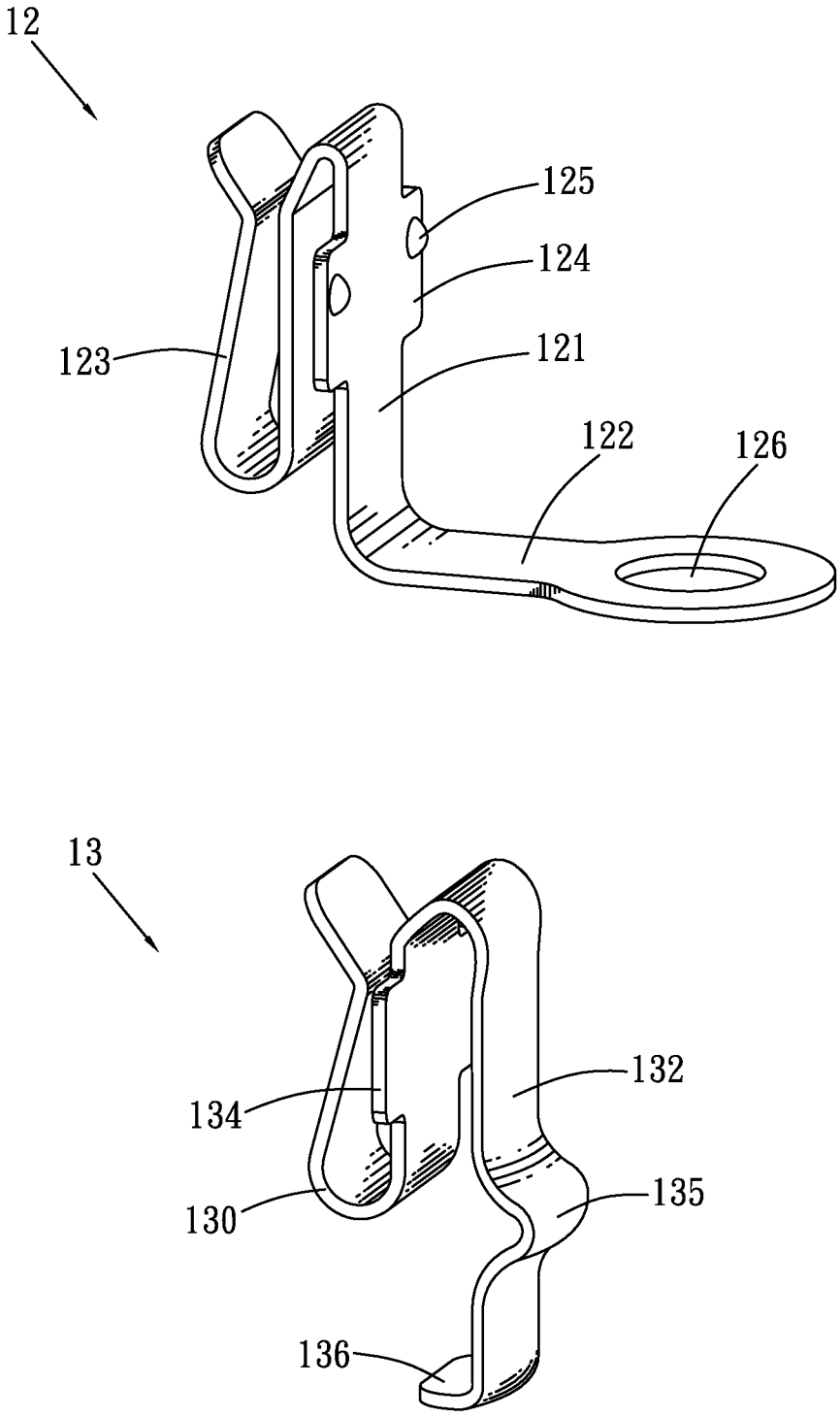
FIG. 4 is a perspective view of an anode terminal and a cathode terminal of the LED bulb of FIG. 2.
Figure 5:
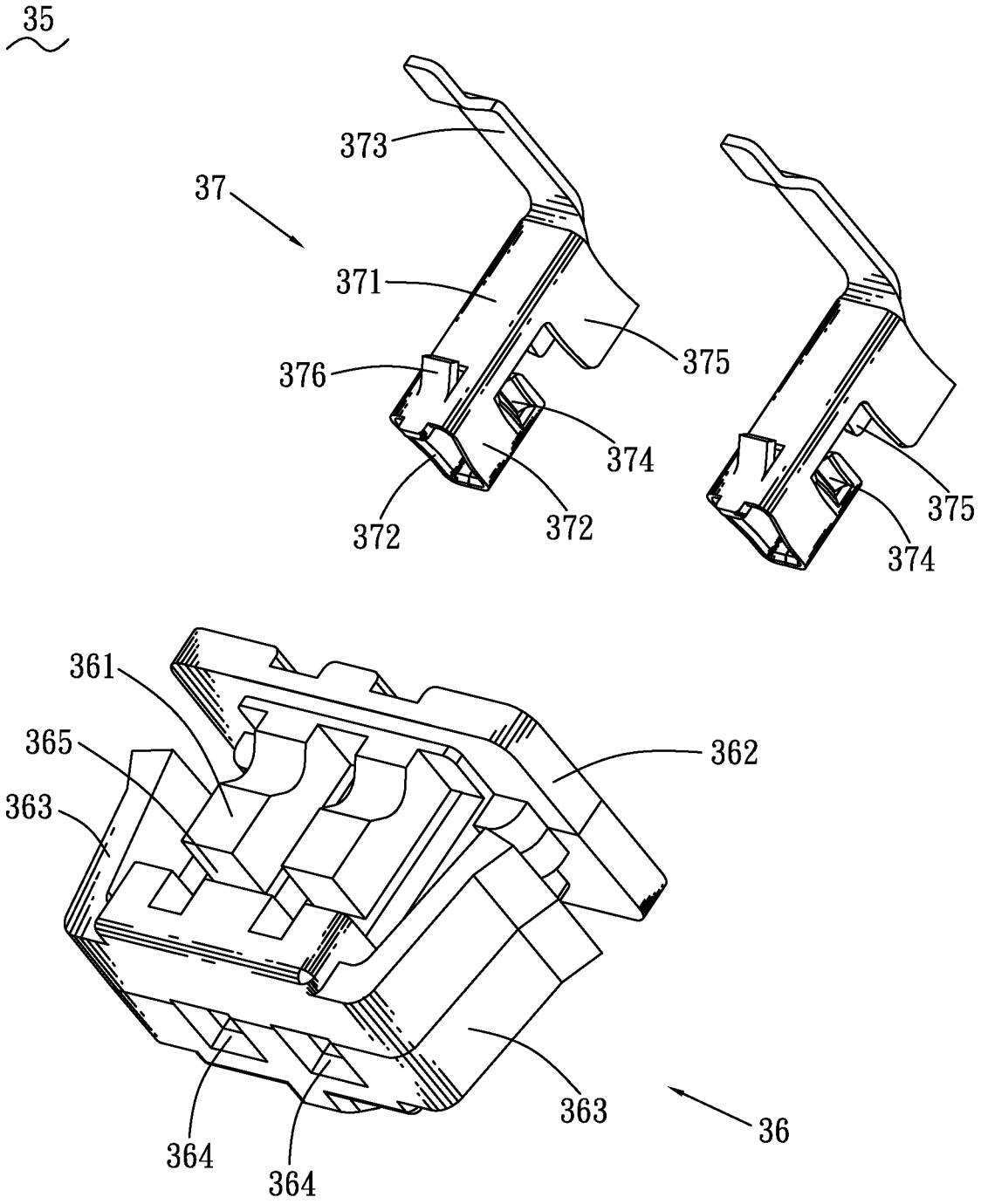
FIG. 5 is an exploded perspective view of a female connector of the LED bulb of FIG. 2.

Referring to FIG. 2, FIG. 3 and FIG. 4, the electrical terminals are apart disposed in the housing 11 and includes an anode terminal 12 and a cathode terminal 13. The anode terminal 12 has a base portion 121 of vertical long board shape, a first connecting portion 122 of long board shape perpendicularly extending sideward from a bottom end of the base portion 121, and a U-shaped first contact portion 123 bent and extending oppositely to the first connecting portion 122 from a top end of the base portion 121. Two top parts of two arms of the first contact portion 123 are arched towards each other to make the first contact portion 123 have a strong grasping force. A free end of the first connecting portion 122 defines an inserting hole 126. Two side edges of the base portion 121 oppositely protrude sideward to form two fastening ears 124 on which two interfering lumps 125 are protruded respectively. The fastening ears 124 are fixed in the fastening slots 113 of the housing 11 by virtue of the interfering lumps 125 interfering with inner sides of the fastening slots 113, so as to make the base portion 121 and the first contact portion 123 steadily located between the fastening blocks 111. The first connecting portion 122 abuts on the bottom wall of the housing 11 to make the inserting hole 126 and the through hole 120 aligned with each other.

The cathode terminal 13 has a U-shaped second contact portion 130 and a second connecting portion 132 which is bent oppositely to the second contact portion 130 from one top end of the second contact portion 130 and then extends downward. A lower part of the second connecting portion 132 is arched outward to form a resisting portion 135. A bottom end of the second connecting portion 132 is bent towards a direction opposite to the resisting portion 135 to form a restraining portion 136. Two side edges of one arm of the second contact portion 130 connected with the second connecting portion 132 oppositely protrude sideward to form a pair of fixing ears 134. A top part of the other arm of the second contact portion 130 is arched towards the one arm of the second contact portion 130 to make the second contact portion 130 have a strong grasping force. The cathode terminal 13 is disposed in the receiving chamber 114 of the housing 11 by virtue of the fixing ears 134 being fixed in the fixing fillisters 116. The bent part of the second contact portion 130 is propped by the supporting board 115. The resisting portion 135 projects out of the housing 11 and corresponds to the male thread 110. The restraining portion 136 is restrained under the bottom wall of the housing 11.

Referring to FIG. 1, FIG. 2, FIG. 6 and FIG. 7, the power connection unit 14 is mounted to a bottom of the housing 11 and electrically connects with the electrical terminals. The power connection unit 14 includes a cylinder bulb base 141 and an anode element 142 which is mounted to a bottom of the bulb base 141 and projects upward in the bulb base 141. The bulb base 141 defines a female thread 143 around the inside thereof. The power connection unit 14 and the housing 11 are screwed together by the female thread 143 and the male thread 110, so that the resisting portion 135 is pressed by and abuts against the bulb base 141 to realize an electrical connection between the cathode terminal 13 and the bulb base 141. A top end of the anode element 142 passes through the through hole 120 of the housing 11 and the inserting hole 126 of the anode terminal 12 to be riveted with the first connecting portion 122 so as to realize an electrical connection between the anode terminal 12 and the anode element 142. In this embodiment, the anode element 142 includes a rivet 144 and a rivet boot 145 in which the rivet 144 is inserted, in detail, a top end of the rivet 144 passes through the through hole 120 and the inserting hole 126 to be riveted with the first connecting portion 122.

Figure 6:
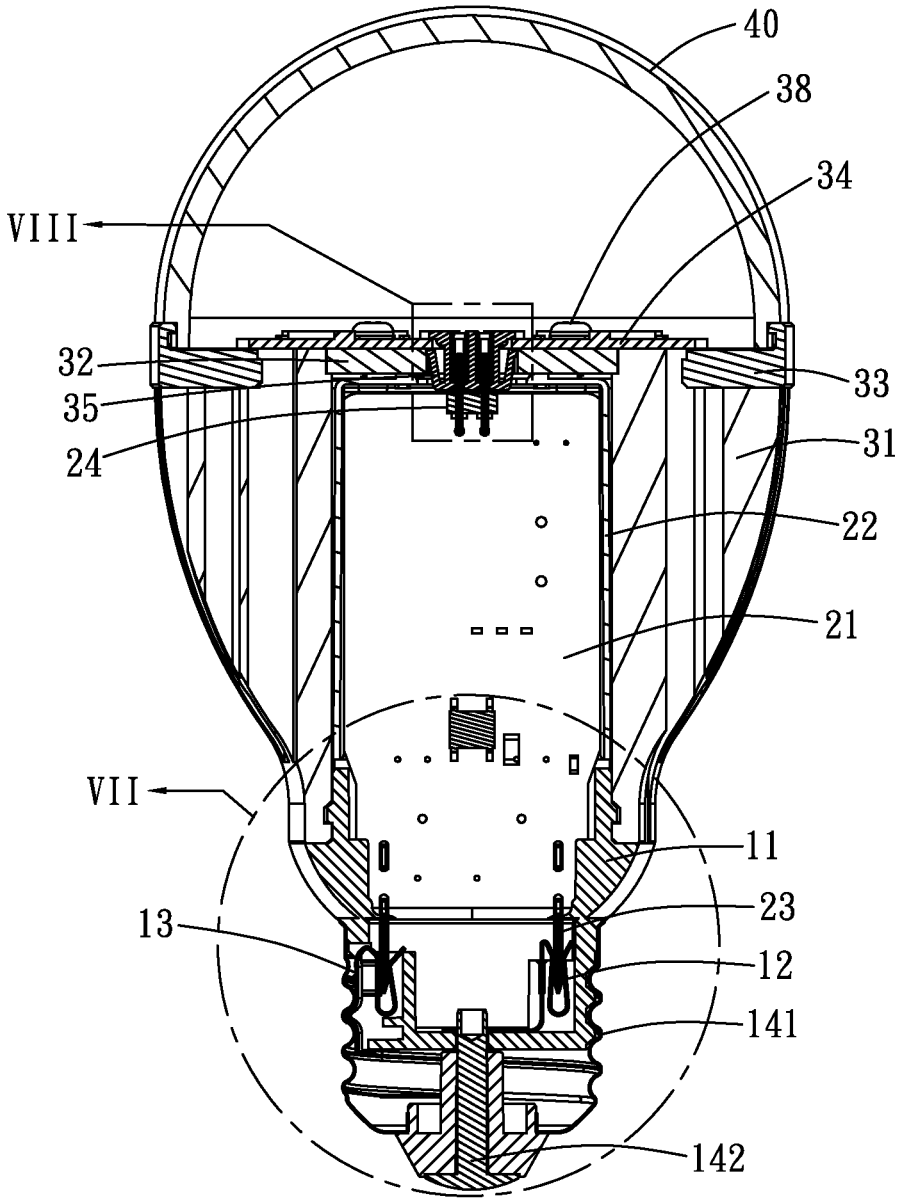
FIG. 6 is a cross-sectional view of the LED bulb of FIG. 1.
Figure 7:
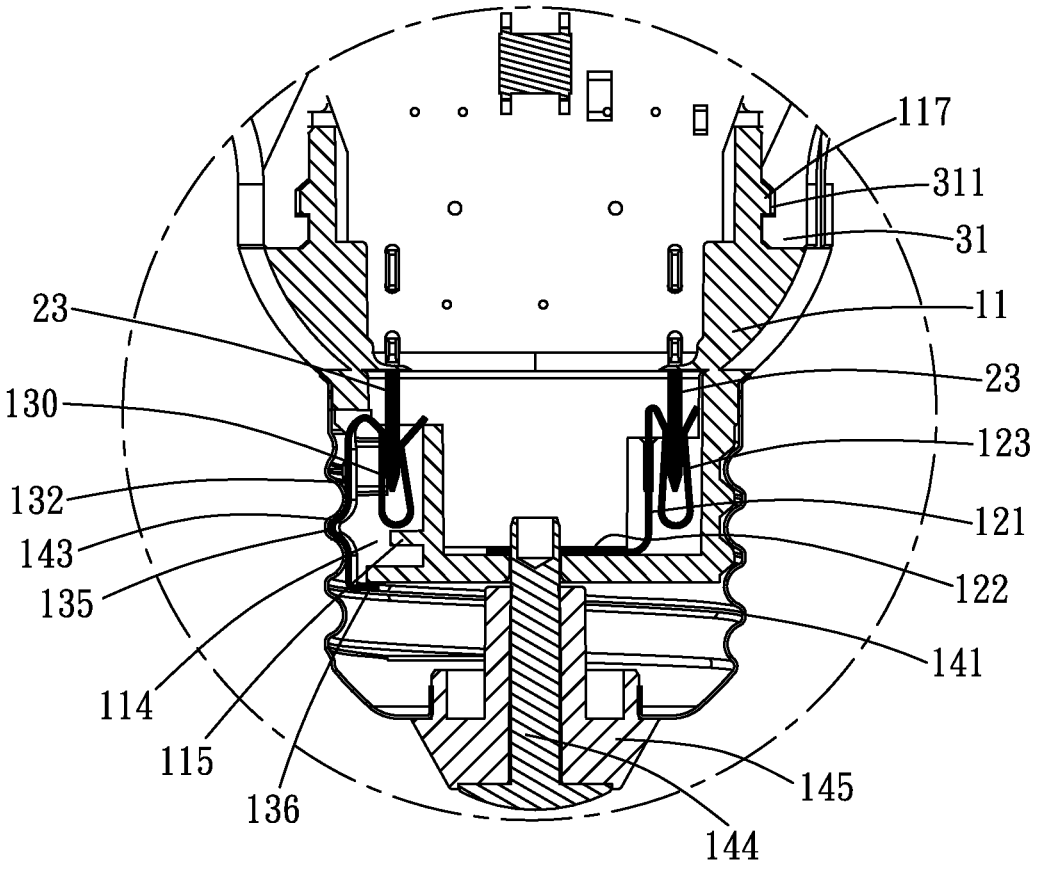
FIG. 7 is an enlarged view of an encircled part VII shown in FIG. 6.
Figure 8:
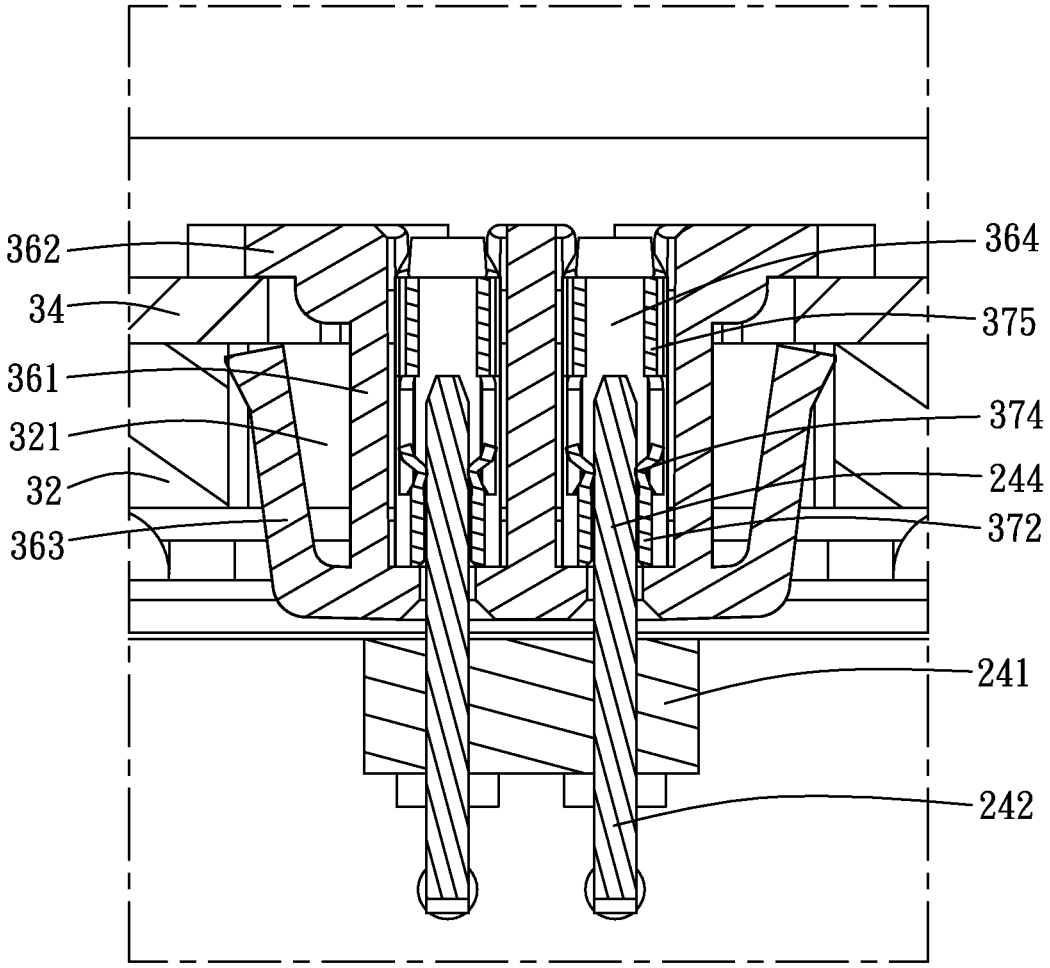
FIG. 8 is an enlarged view of an encircled part VIII shown in FIG. 6.

Referring to FIG. 2, FIG. 6 and FIG. 7, the power module 20 includes a power PCBA 21 of which a bottom is equipped with two sheet power pins 23 and a top is equipped with a male connector 24 electrically connecting with the power pins 23. The power PCBA 21 is vertically mounted on the housing 11 by virtue of two ends of the bottom thereof being inserted in the positioning slots 11*b*. The power pins 23 are inserted and clamped in the first contact portion 123 and the second contact portion 130 to realize electrical connection with the anode terminal 12 and the cathode terminal 13, respectively.

The male connector 24 includes a male body 241 and male terminals 242. The male terminals 242 are disposed in the male body 241 and each has a soldering arm 243 and an inserting arm 244. The soldering arms 243 are inserted in the power PCBA 21 and electrically connected with the power pins 23 respectively. The power module 20 further includes a cylinder shell 22 enclosing the power PCBA 21. A top plate of the shell 22 defines an opening 221 through which the inserting arms 244 of the male terminals 242 pass to stretch upward. A plurality of locking fillisters 222 is further concaved downward in the top plate of the shell 22.

Referring to FIG. 2, FIG. 6 and FIG. 7 again, the illumination module 30 includes a scatter-hot body 31 of hollow cone shape, a scatter-hot board 32, an assembling ring 33 and a LED PCB 34. The inner side of a bottom opening of the scatter-hot body 31 defines a ring-shaped locking channel 311 and at least one positioning groove (not shown). The scatter-hot body 31 is mounted on the housing 11 by buckling the locking rib 117 in the locking channel 311. The positioning portion 118 is located in the positioning groove to avoid a relative rotation of the scatter-hot body 31 and the housing 11. The power PCBA 21 and the shell 22 are received in the scatter-hot body 31. In assembly, the housing 11 utilizes the gap 119 to achieve an easy assembly and a hard disassembly with the scatter-hot body 31, and the assembly still is very firm even if a high temperature happens in use.

The scatter-hot board 32 is mounted at a top opening of the scatter-hot body 31, and defines a window 321 and a plurality of locking holes 322 in alignment with the opening 221 and the locking fillisters 222 of the shell 22 respectively. The assembling ring 33 is mounted on the scatter-hot body 31. The LED PCB 34 is equipped with a female connector 35 and defines a plurality of locking apertures 341. The LED PCB 34 is mounted to the top of the power PCBA 21 and electrically connects with the power PCBA 21 by virtue of the female connector 35 and the male connector 24 being mated with each other. The LED PCB 34 is further located above the scatter-hot body 31 and fixed on the scatter-hot board 32 by a plurality of locking elements 38 each being bolted in the locking aperture 341, the locking hole 322 and the locking fillister 222. In this embodiment, the locking element 38 is a screw.

Referring to FIG. 2, FIG. 5, FIG. 6 and FIG. 8, the female connector 35 includes a female body 36 and female terminals 37. The female body 36 has a base body 361 of which a top edge peripherally protrudes outward to form a blocking eave 362. Bottom ends of two opposite sides of the base body 361 protrude outward and then slantwise extend upward to form a pair of elastic arms 363 apart located under the blocking eave 362. The female body 36 defines a plurality of terminal passageways 364 vertically penetrating through the base body 361. A front inner side of the terminal passageway 364 is concaved to form a buckling groove 365.

Each of the female terminals 37 has a base plate 371 placed vertically, a pair of side plates 372 slantwise extending rearward and upward from two opposite side edges of the base plate 371 and then bent to be jointed together, a soldering tail 373 perpendicularly extending forward from a top end of the base plate 371, and a pair of clamping portions 374 formed by tops of two opposite sides of the side plates 372 being arched towards each other. The two opposite side edges of the base plate 371 further slantwise extend rearward to form a pair of fastening plates 375 located above the side plates 372. A bottom of the base plate 371 is punched forward to form a buckling slice 376. The female terminal 37 is firmly received in the corresponding terminal passageway 364 by virtue of the fastening plates 375 interfering with two opposite inner sides of the terminal passageway 364, and the buckling slice 376 being buckled in the buckling groove 365. The soldering tails 373 project in front of the blocking eave 362 of the female body 36.

The female connector 35 is embedded in the LED PCB 34 by clamping the LED PCB 34 between the blocking eave 362 and the elastic arms 363 of the female body 36. The soldering tails 373 of the female terminals 37 are soldered on the LED PCB 34. A lower part of the female connector 35 passes through the window 321 of the scatter-hot board 32 and the opening 221 of the shell 22 to be mated with the male connector 24 of the power PCBA 21. The inserting arms 244 of the male terminals 242 are inserted in the terminal passageways 364 of the female body 36 and electrically clamped between the clamping portions 374 of the female terminals 37 respectively. Lastly, the cover 40 is mounted to the assembling ring 33 and covers the LED PCB 34.

As described above, the electrical connection between the LED head 10 and the power PCBA 21 and between the power PCBA 21 and the LED PCB 34 is realized by the power connection unit 14 and the electrical terminals, the electrical terminals and the power pins 23, and the male connector 24 and the female connector 35 instead of wires. It effectively saves the space inside the LED bulb 100. Moreover, the above-mentioned connection way can achieve steady electrical connection even if a high temperature happens in use. So the LED bulb 100 of the present invention has a safe use and a steady illumination.

What is claimed is:

1. A LED bulb, comprising:

a bulb head including a housing, a plurality of electrical terminals and a power connection unit, the electrical terminals being apart disposed in the housing and including an anode terminal and a cathode terminal, the power connection unit being mounted to a bottom of the housing and including a bulb base and an anode element, the anode element being mounted to a bottom of the bulb base and projecting upward in the bulb base, one end of the anode terminal being electrically connected with a top end of the anode element, one end of the cathode terminal projecting outside the housing to be electrically connected with the bulb base;

a power PCBA of which a bottom is equipped with two power pins, the power PCBA being mounted on the housing, the power pins being electrically connected with another two ends of the anode terminal and the cathode terminal respectively;

a LED PCB mounted to a top of the power PCBA and electrically connecting with the power PCBA; and a cover covered on the LED PCB;

wherein a ring-shaped locking rib is protruded outward around the outside of a top end of the housing, the top end of the housing further defines at least one gap and at least one positioning portion, the LED bulb further includes a scatter-hot body of which the inner side of a bottom opening defines a ring-shaped locking channel and at least one positioning groove, the scatter-hot body is mounted on the housing by buckling the locking rib in the locking channel and locating the positioning portion in the positioning groove, the power PCBA is received in the scatter-hot body and the LED PCB is located above the scatter-hot body.

2. The LED bulb as claimed in claim 1, wherein two opposite parts of the insidewall of the housing protrude inward to form a pair of positioning blocks, a pair of positioning slots is opened in two face-to-face sides of the positioning blocks and further penetrates upward through the positioning blocks respectively, two ends of the bottom of the power PCBA are inserted in the positioning slots.

3. The LED bulb as claimed in claim 1, wherein the anode terminal has a first connecting portion of long board shape of which a free end defines an inserting hole, a bottom wall of the housing defines a through hole, the inserting hole and the through hole are aligned with each other, the top end of the anode element passes through the through hole and the inserting hole to be riveted with the first connecting portion of the anode terminal.

4. The LED bulb as claimed in claim 1, wherein the anode terminal has a U-shaped first contact portion, the power pin of the power PCBA is inserted and clamped in the first contact portion.

5. The LED bulb as claimed in claim 1, wherein the anode terminal has a base portion of vertical long board shape, a first connecting portion perpendicularly extending sideward from a bottom end of the base portion, and a first contact portion bent and extending oppositely to the first connecting portion from a top end of the base portion, the first connecting portion is electrically connected with the top end of the anode element by the riveting pressure, the power pin of the power PCBA is electrically connected with the first contact portion.

6. The LED bulb as claimed in claim 1, wherein one end of the cathode terminal is arched outward to form a resisting portion, the housing defines a male thread around the outside of a bottom part thereof, the resisting portion projects out of the housing and is corresponded to the male thread, the bulb base defines a female thread around the inside thereof, the power connection unit and the housing are screwed together by the female thread and the male thread, the resisting portion is pressed by and abuts against the bulb base.

7. The LED bulb as claimed in claim 1, wherein the cathode terminal has a U-shaped second contact portion, the power pin of the power PCBA is inserted and clamped in the second contact portion.

8. The LED bulb as claimed in claim 7, wherein the cathode terminal further has a second connecting portion which is bent oppositely to the second contact portion from one top end of the second contact portion and then extends downward, a lower part of the second connecting portion is arched outward to form a resisting portion projecting outside the housing to be electrically connected with the bulb base.

9. The LED bulb as claimed in claim 8, wherein a bottom end of the second connecting portion is bent towards a direction opposite to the resisting portion to form a restraining portion restrained under the bottom wall of the housing.

10. The LED bulb as claimed in claim 1, wherein a top of the power PCBA is equipped with a male connector including a male body and male terminals, the male terminals are disposed in the male body and each has a soldering arm and an inserting arm, the soldering arms are inserted in the power PCBA and electrically connected with the power pins respectively, the LED PCB is equipped with a female connector including a female body and female terminals, the female body defines a plurality of terminal passageways vertically penetrating therethrough, the female terminals are received in the terminal passageways and each has a soldering tail and a pair of clamping portions, the soldering tails project in front of the female body and are soldered on the LED PCB, the female connector is mated with the male connector, the inserting arms of the male terminals are inserted in the terminal passageways of the female body and electrically clamped between the clamping portions of the female terminals respectively.

11. The LED bulb as claimed in claim 10, wherein the female terminal further has a base plate placed vertically, two opposite side edges of the base plate slantwise extend rearward and then are bent to be jointed together to form a pair of side plates, a top end of the base plate extends forward to form the soldering tail, and two opposite sides of the side plates are arched towards each other to form the pair of clamping portions.

12. The LED bulb as claimed in claim 11, wherein the two opposite side edges of the base plate further slantwise extend rearward to form a pair of fastening plates located above the side plates and interfering with two opposite inner sides of the terminal passageway, a bottom of the base plate is punched forward to form a buckling slice, a front inner side of the terminal passageway is concaved to form a buckling groove for buckling the buckling slice of the female terminal therein.

13. The LED bulb as claimed in claim 10, wherein the female body has a base body, a top edge of the base body peripherally protrudes outward to form a blocking eave, bottom ends of two opposite sides of the base body protrude outward and then slantwise extend upward to form a pair of elastic arms apart located under the blocking eave, the female connector is embedded in the LED PCB by clamping the LED PCB between the blocking eave and the elastic arms.

14. A LED bulb, comprising:

a bulb head including a housing, a plurality of electrical terminals and a power connection unit, the electrical terminals being apart disposed in the housing and including an anode terminal and a cathode terminal, the power connection unit being mounted to a bottom of the housing and including a bulb base and an anode element, the anode element being mounted to a bottom of the bulb base and projecting upward in the bulb base, one end of the anode terminal being electrically connected with a top end of the anode element, one end of the cathode terminal projecting outside the housing to be electrically connected with the bulb base;

a power PCBA of which a bottom is equipped with two power pins, the power PCBA being mounted on the housing, the power pins being electrically connected with another two ends of the anode terminal and the cathode terminal respectively;

a LED PCB mounted to a top of the power PCBA and electrically connecting with the power PCBA; and a cover covered on the LED PCB;

wherein the anode terminal has a first connecting portion of long board shape of which a free end defines an inserting hole, a bottom wall of the housing defines a through hole, the inserting hole and the through hole are aligned with each other, the top end of the anode element passes through the through hole and the inserting hole to be riveted with the first connecting portion of the anode terminal.

15. A LED bulb, comprising:

a bulb head including a housing, a plurality of electrical terminals and a power connection unit, the electrical terminals being apart disposed in the housing and including an anode terminal and a cathode terminal, the power connection unit being mounted to a bottom of the housing and including a bulb base and an anode element, the anode element being mounted to a bottom of the bulb base and projecting upward in the bulb base, one end of the anode terminal being electrically connected with a top end of the anode element, one end of the cathode terminal projecting outside the housing to be electrically connected with the bulb base;

a power PCBA of which a bottom is equipped with two power pins, the power PCBA being mounted on the housing, the power pins being electrically connected with another two ends of the anode terminal and the cathode terminal respectively;

a LED PCB mounted to a top of the power PCBA and electrically connecting with the power PCBA; and a cover covered on the LED PCB;

wherein the anode terminal has a base portion of vertical long board shape, a first connecting portion perpendicularly extending sideward from a bottom end of the base portion, and a first contact portion bent and extending oppositely to the first connecting portion from a top end of the base portion, the first connecting portion is electrically connected with the top end of the anode element by the riveting pressure, the power pin of the power PCBA is electrically connected with the first contact portion.

16. A LED bulb, comprising:

a bulb head including a housing, a plurality of electrical terminals and a power connection unit, the electrical terminals being apart disposed in the housing and including an anode terminal and a cathode terminal, the power connection unit being mounted to a bottom of the housing and including a bulb base and an anode element, the anode element being mounted to a bottom of the bulb base and projecting upward in the bulb base, one end of the anode terminal being electrically connected with a top end of the anode element, one end of the cathode terminal projecting outside the housing to be electrically connected with the bulb base;

a power PCBA of which a bottom is equipped with two power pins, the power PCBA being mounted on the housing, the power pins being electrically connected with another two ends of the anode terminal and the cathode terminal respectively;

a LED PCB mounted to a top of the power PCBA and electrically connecting with the power PCBA; and a cover covered on the LED PCB;

wherein a top of the power PCBA is equipped with a male connector including a male body and male terminals, the male terminals are disposed in the male body and each has a soldering arm and an inserting arm, the soldering arms are inserted in the power PCBA and electrically connected with the power pins respectively, the LED PCB is equipped with a female connector including a female body and female terminals, the female body defines a plurality of terminal passageways vertically penetrating therethrough, the female terminals are received in the terminal passageways and each has a soldering tail and a pair of clamping portions, the soldering tails project in front of the female body and are soldered on the LED PCB, the female connector is mated with the male connector, the inserting arms of the male terminals are inserted in the terminal passageways of the female body and electrically clamped between the clamping portions of the female terminals respectively;

wherein the female body has a base body, a top edge of the base body peripherally protrudes outward to form a blocking eave, bottom ends of two opposite sides of the base body protrude outward and then slantwise extend upward to form a pair of elastic arms apart located under the blocking eave, the female connector is embedded in the LED PCB by clamping the LED PCB between the blocking eave and the elastic arms.

* * * * *